US011891772B2

(12) United States Patent
Ryan

(10) Patent No.: US 11,891,772 B2
(45) Date of Patent: Feb. 6, 2024

(54) SYSTEM AND METHOD FOR ESTIMATING A PAYLOAD OF AN INDUSTRIAL MACHINE

(71) Applicant: Joy Global Surface Mining Inc, Milwaukee, WI (US)

(72) Inventor: Paul Ryan, Mukwonago, WI (US)

(73) Assignee: JOY GLOBAL SURFACE MINING INC, Milwaukee, WI (US)

( * ) Notice: Subject to any disclaimer, the term of this patent is extended or adjusted under 35 U.S.C. 154(b) by 487 days.

(21) Appl. No.: 17/216,152

(22) Filed: Mar. 29, 2021

(65) Prior Publication Data

US 2022/0307219 A1 Sep. 29, 2022

(51) Int. Cl.

| | |
|---|---|
| ***E02F 3/42*** | (2006.01) |
| ***E02F 3/30*** | (2006.01) |
| ***E02F 9/26*** | (2006.01) |
| *E21C 27/30* | (2006.01) |

(52) U.S. Cl.
CPC ..... *E02F 3/308* (2013.01); *E02F 9/265* (2013.01); *E21C 27/30* (2013.01)

(58) Field of Classification Search
CPC ..... E21C 27/30; E02F 3/308; E02F 9/265
See application file for complete search history.

(56) References Cited

U.S. PATENT DOCUMENTS

| | | | |
|---|---|---|---|
| 7,472,009 | B2 | 12/2008 | Baldwin |
| 8,209,096 | B2 | 6/2012 | Claxton |
| 8,271,229 | B2 | 9/2012 | Hsu et al. |
| 8,311,970 | B2 | 11/2012 | McAree et al. |
| 8,346,512 | B2 | 1/2013 | McAree et al. |
| 8,373,078 | B2 | 2/2013 | Madhavarao et al. |
| 8,515,627 | B2 | 8/2013 | Marathe et al. |
| 8,660,758 | B2 | 2/2014 | Janardhan et al. |
| 8,788,245 | B2 | 7/2014 | Taylor |
| 8,886,493 | B2 | 11/2014 | Taylor |
| 8,909,437 | B2 | 12/2014 | Zhu et al. |
| 8,924,094 | B2 * | 12/2014 | Faivre ..... G01G 19/083 172/465 |
| 8,930,091 | B2 | 1/2015 | Upcroft et al. |
| 9,091,586 | B2 * | 7/2015 | Hague ..... G01G 19/083 |
| 9,328,483 | B2 | 5/2016 | Claxton |
| 9,464,403 | B2 * | 10/2016 | Shatters ..... G01G 23/01 |
| 9,957,690 | B2 | 5/2018 | Colwell et al. |

(Continued)

FOREIGN PATENT DOCUMENTS

| | | |
|---|---|---|
| AU | 2010236018 | 5/2012 |
| AU | 2017254937 A1 | 5/2018 |

(Continued)

*Primary Examiner* — Dalena Tran
(74) *Attorney, Agent, or Firm* — Husch Blackwell LLP

(57) ABSTRACT

A method of determining a payload mass, the method comprising receiving rope data indicative of the rope force from the rope force sensor, receive position data indicative of the current shovel position from the one or more position sensors, determine a payload mass based on the rope force, the current shovel position, and a defined relationship between a kinetic energy of the mining shovel, a potential energy of the mining shovel, one or more degrees of freedom of the mining shovel, and one or more forces experienced by the mining shovel, and provide the payload mass to a display device associated with the mining shovel.

30 Claims, 6 Drawing Sheets

(56) References Cited

U.S. PATENT DOCUMENTS

| | | | | |
|---|---|---|---|---|
| 10,048,154 | B2 | 8/2018 | Claxton | |
| 10,221,542 | B2 | 3/2019 | Lee et al. | |
| 10,273,655 | B2 | 4/2019 | Colwell et al. | |
| 10,316,490 | B2 | 6/2019 | Lee | |
| 11,226,225 | B2 * | 1/2022 | Sherlock | G01G 23/01 |
| 11,668,077 | B2 * | 6/2023 | Sawodny | B25J 9/1638 37/348 |
| 2020/0131739 | A1 | 4/2020 | Ueda et al. | |
| 2020/0157775 | A1 | 5/2020 | Sawodny et al. | |

FOREIGN PATENT DOCUMENTS

| | | | |
|---|---|---|---|
| EP | 2843378 | A1 | 3/2015 |
| WO | 2009054736 | A1 | 4/2009 |
| WO | 2015166210 | A1 | 11/2015 |
| WO | 2019002258 | A1 | 1/2019 |

* cited by examiner

SYSTEM AND METHOD FOR ESTIMATING A PAYLOAD OF AN INDUSTRIAL MACHINE

TECHNICAL FIELD

The present application relates to industrial machines, and more particularly, a system and method for estimating a payload of an industrial machine.

BACKGROUND

Industrial machines include, but are not limited to, mining shovels (e.g., electric rope shovels or hybrid rope shovels), draglines, hydraulic machines, and backhoes. Industrial machines, such as electric ropes or power shovels, draglines, hydraulic machines, backhoes, etc., are used to execute operations with a work implement, for example, digging to remove material from a bank of a mine with a bucket (or dipper). These machines and/or their work implements are generally driven by actuator(s), such as but not limited to, electric motors, hydraulic systems, etc. to load material in and out of the bucket. An amount of the material within the bucket of an industrial machine may be referred to as a payload.

SUMMARY

Some industrial machines generate payload data that includes an estimate of the amount of mined material within a bucket of the machine. Use of payload data allows an operator to track loading of the industrial machine and prevent from overloading the machine. Additionally, payload data can help provide feedback to an operator during loading and assist in improving dig efficiency. The payload data may be determined by using one or more torque estimations of various actuators (e.g., one or more motors or actuators) of the machine. However, such payload estimations are problematic because the actuators, the torque of which is estimated, are often times located a significant distance from the actual payload (e.g., from the bucket containing the mined material). Additionally, with certain types of actuators, such as certain types of motors, torque estimation may be inaccurate, which causes inaccuracies in payload estimates based on such torque estimates. Further, some payload estimations require complicated, computationally expensive functions, such as recursive functions that, to generate a single (final) payload estimation, generate many intermediate payload estimations with weighted components that change over time based on analysis of the estimations.

Accordingly, there is a need for a new method and system for estimating a payload of an industrial machine. In embodiments described herein, the system of the industrial machine may be analyzed using a payload function of generalized coordinates for the system, the energy in the system defined based on known kinematics of the system, and a time component to obtain payload data without the need for torque estimates. The payload function may receive inputs such as a hoist force and position information for relevant components of the system, and provide as output a payload estimation. Additionally, the payload function, which may be derived using principals of Lagrange's Equation, may be customized based on precision needs and memory size. Accordingly, embodiments described herein provide more accurate payload estimations without use of complex, computationally expensive functions.

Therefore, in one embodiment, a mining shovel includes a base, a handle rotationally coupled to the base, and a bucket coupled to the handle. A rope force sensor is configured to indicate a rope force on a rope supporting the bucket and the handle. One or more position sensors are configured to indicate a current shovel position. A controller including an electronic processor and a memory is coupled to the rope force sensor and to the one or more position sensors. The controller is configured to receive rope data indicative of the rope force from the rope force sensor, receive position data indicative of the current shovel position from the one or more position sensors, determine a payload mass based on the rope force, the current shovel position, and a defined relationship between a kinetic energy of the mining shovel, a potential energy of the mining shovel, one or more degrees of freedom of the mining shovel, and one or more forces experienced by the mining shovel, and provide the payload mass to a display device associated with the mining shovel.

In another embodiment, a method is provided for determining a payload mass for a mining shovel. The method includes receiving, at an electronic processor, rope data from a rope force sensor indicative of a rope force on a rope supporting a bucket and a handle of the mining shovel, receiving, at the electronic processor, position data from one or more position sensors indicative of a current shovel position of the mining shovel, determining a payload mass based on the rope force, the current shovel position, and a defined relationship between a kinetic energy of the mining shovel, a potential energy of the mining shovel, one or more degrees of freedom of the mining shovel, and one or more forces experienced by the mining shovel, and providing the payload mass to a display device associated with the mining shovel.

In another embodiment, control system is provided for a mining machine having a base, a handle rotationally coupled to the base, a bucket coupled to the handle, a rope force sensor configured to indicate a rope force on a rope supporting the bucket and the handle, and one or more position sensors configured to indicate a current shovel position. The control system includes an electronic controller including an electronic processor and a memory, the electronic controller coupled to the rope force sensor and to the one or more position sensors. The electronic controller is configured to receive rope data indicative of the rope force from the rope force sensor, receive position data indicative of the current shovel position from the one or more position sensors, determine a payload mass based on the rope force, the current shovel position, and a defined relationship between a kinetic energy of the mining shovel, a potential energy of the mining shovel, one or more degrees of freedom of the mining shovel, and one or more forces experienced by the mining shovel, and provide the payload mass to a display device associated with the mining shovel.

Other aspects of the application will become apparent by consideration of the detailed description and accompanying drawings.

DETAILED DESCRIPTION

Figure 1:
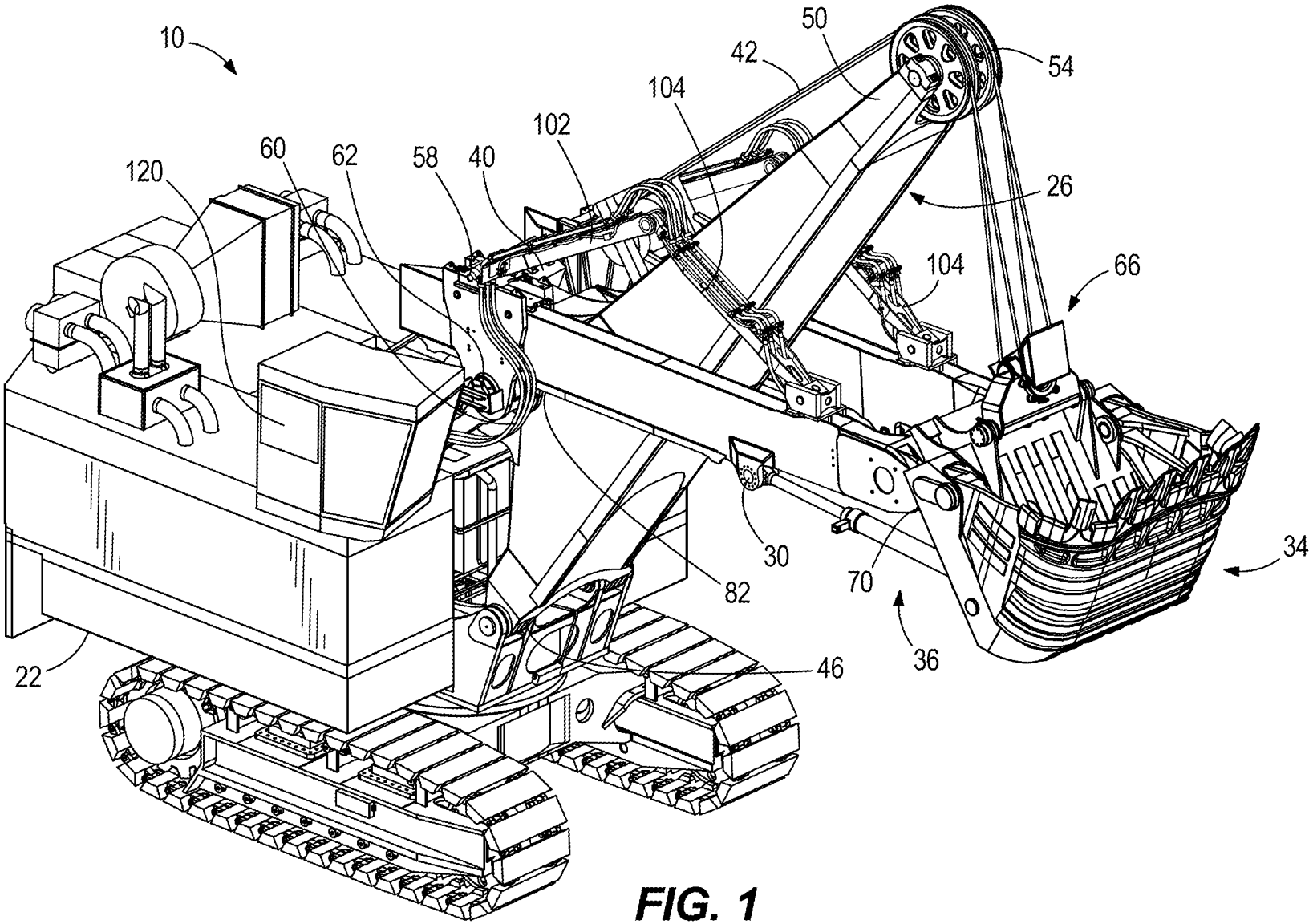
FIG. 1 illustrates an industrial machine according to some embodiments of the application.

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the application. In addition, it should be understood that embodiments of the application may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the application may be implemented in software (e.g., stored on non-transitory computer-readable medium) executable by one or more processors. As such, it should be noted that a plurality of hardware and software based devices, as well as a plurality of different structural components may be utilized to implement the application. Furthermore, and as described in subsequent paragraphs, the specific mechanical configurations illustrated in the drawings are intended to exemplify embodiments of the application and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4." The relative terminology may refer to plus or minus a percentage (e.g., 1%, 5%, 10%, or more) of an indicated value.

Functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not explicitly listed.

Figure 2:
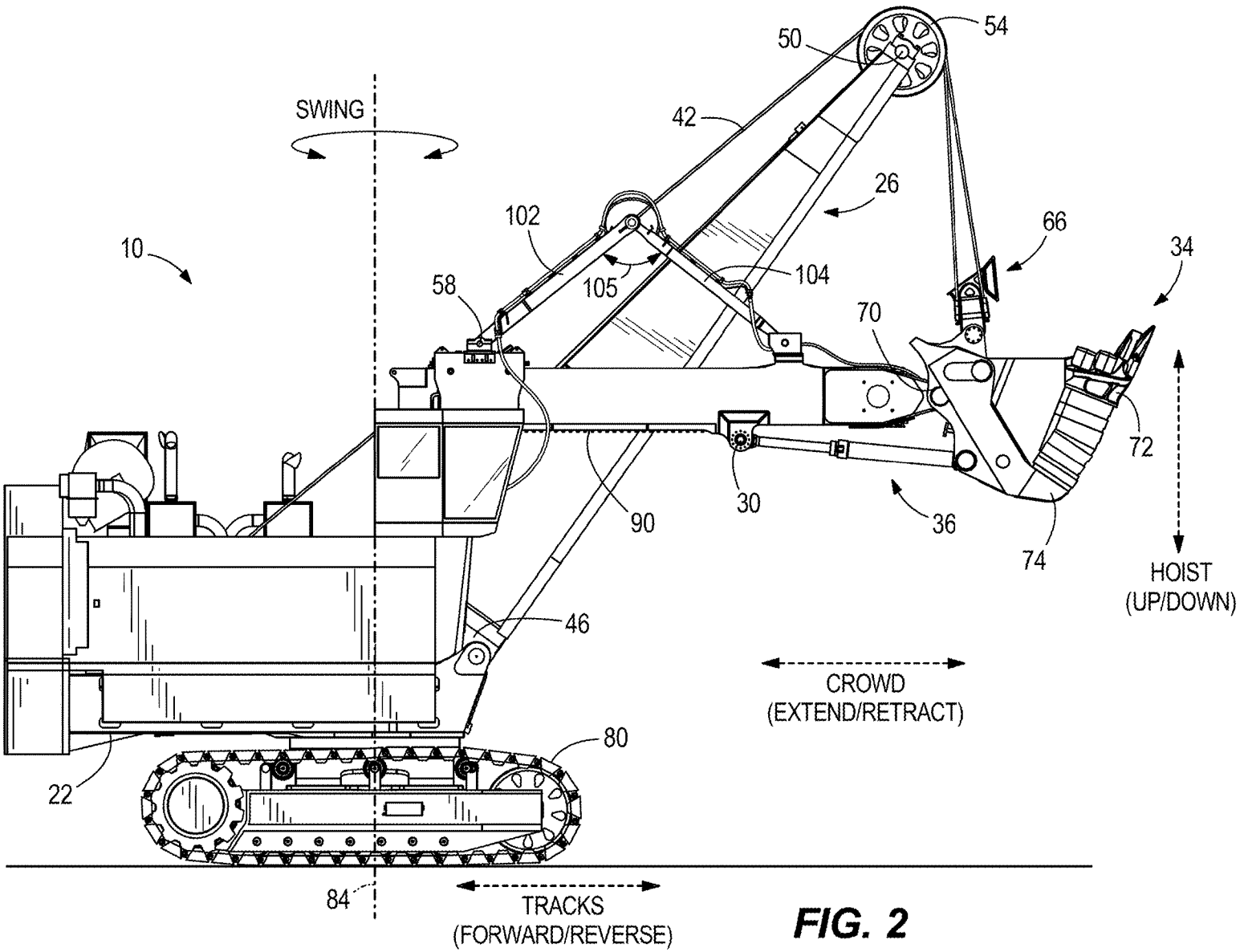
FIG. 2 is a side view of the industrial machine of FIG. 1 according to some embodiments of the application.

Although the application described herein can be applied to, performed by, or used in conjunction with a variety of industrial machines (e.g., a mining machine, a rope shovel, a dragline with hoist and drag motions, a hydraulic machine, a backhoe, etc.), embodiments of the application described herein are described with respect to an electric rope or power shovel, such as the mining machine illustrated in FIGS. 1 and 2. The embodiment shown in FIGS. 1 and 2 illustrates a mining shovel 10, as a hybrid rope shovel, however in other embodiments the mining shovel 10 can be a different type of mining machine, for example, an electric rope shovel, a dragline excavator, etc. The mining shovel 10 rests on a support surface, or floor, and includes a base or frame 22, a boom 26, a first member or handle 30, a dipper or bucket 34, and a pivot actuator 36 (also referred to as a tilt cylinder). The base 22 includes a hoist drum 40 (FIG. 1) for reeling in and letting out a hoist cable 42, also referred to as a rope 42. The boom 26 includes a first end 46 coupled to the base 22, a second end 50 opposite the first end 46, a boom sheave 54, a saddle block 58, and a shipper shaft 62 (FIG. 1). The boom sheave 54 is coupled to the second end 50 of the boom 26 and guides the rope 42 over the second end 50. The rope 42 is coupled to the bucket 34 by a bail 66. The bucket 34 is raised or lowered as the rope 42 is reeled in or paid out, respectively, by the hoist drum 40. The motion up and down by the bucket 34 due to the rotation of the hoist drum 40 is referred to as hoist motion, which may include hoisting up and hoisting down.

The saddle block 58 is rotatably coupled to the boom 26 by the shipper shaft 62, which is positioned between the first end 46 and the second end 50 of the boom 26 and extends through the boom 26. The handle 30 is moveably coupled to the boom 26 by the saddle block 58. The shipper shaft 62 includes a spline pinion for engaging a rack 90 of the handle 30. The first end 82 of the handle 30 is moveably received in the saddle block 58, and the handle 30 passes through the saddle block 58 such that the handle 30 is configured for rotational and translational movement relative to the boom 26 (FIG. 1). Stated another way, the handle 30 is linearly extendable and retractable relative to the saddle block 58 and is rotatable about the shipper shaft 62. The motion of the bucket 34 in and out due to extension and retraction of the handle 30 is referred to as crowd motion, which may include crowding in and crowding out.

An aft link 102 has a first end pivotably coupled to the saddle block 58. A forward link 104 has a first end pivotably coupled to the handle 30 near a wrist joint 70. The forward link 104 and the aft link 102 are pivotably coupled to each other at their respective second ends. The aft link 102 and forward link 104 together form a link that expands and retracts based on movement of the handle 30. More particularly, the distance between the first ends of the aft link 102 and the forward link 104 increases, and a pivot angle 105 between the links 102, 104 increases, as the handle 30 crowds (extends) outward away from the base 22. In the illustrated embodiment, the handle 30 includes two sets of aft links 102 and a pair of forward links 104, one set on each side of the boom 26.

The bucket 34 is pivotably coupled to the handle 30 at a wrist joint 70. The bail 66 is coupled to the rope 42 passing over the boom sheave 54 and is pivotably coupled to the bucket 34. The pivot actuator 36 controls the pitch or tilt angle of the bucket 34 by rotating the bucket 34 about the wrist joint 70. In the illustrated embodiment, the pivot actuator 36 includes a pair of hydraulic cylinders directly coupled between a lower portion of the handle 30 and a lower portion of the bucket 34. In other embodiments, a different type of actuator may be used. The pivot actuator 36 may include one or more motors, such as but not limited to, direct-current (DC) motors, alternating-current (AC) motors, and switch-reluctance (SR) motors.

In the illustrated embodiment, the bucket 34 is a clamshell-type bucket including a main body 72 and a rear wall 74. The main body 72 is pivotably coupled to the rear wall 74 about a bucket joint and can be controlled by a hydraulic cylinder to open apart to discharge contents within the bucket 34. In some embodiments, the bucket 34 has a different construction, such as a container having a dump door that is selectively activated to swing open to release contents of the bucket 34.

The shovel 10 further includes tracks 80 configured to be driven to move the shovel 10 forward, in reverse, or to turn over a ground surface. The base 22 is further operable to rotate relative to the tracks 80 about a swing axis 84.

The shovel 10 of FIGS. 1 and 2 is an example of a mining shovel that may implement one or more embodiments described herein. However, in some embodiments, mining shovels of a different construction are used. For example, some constructions of the shovel 10 do not include an operator cab 120 or one or more other components as described above. Other constructions of the shovel 10 may include additional components not shown in FIGS. 1 and 2.

Figure 3:
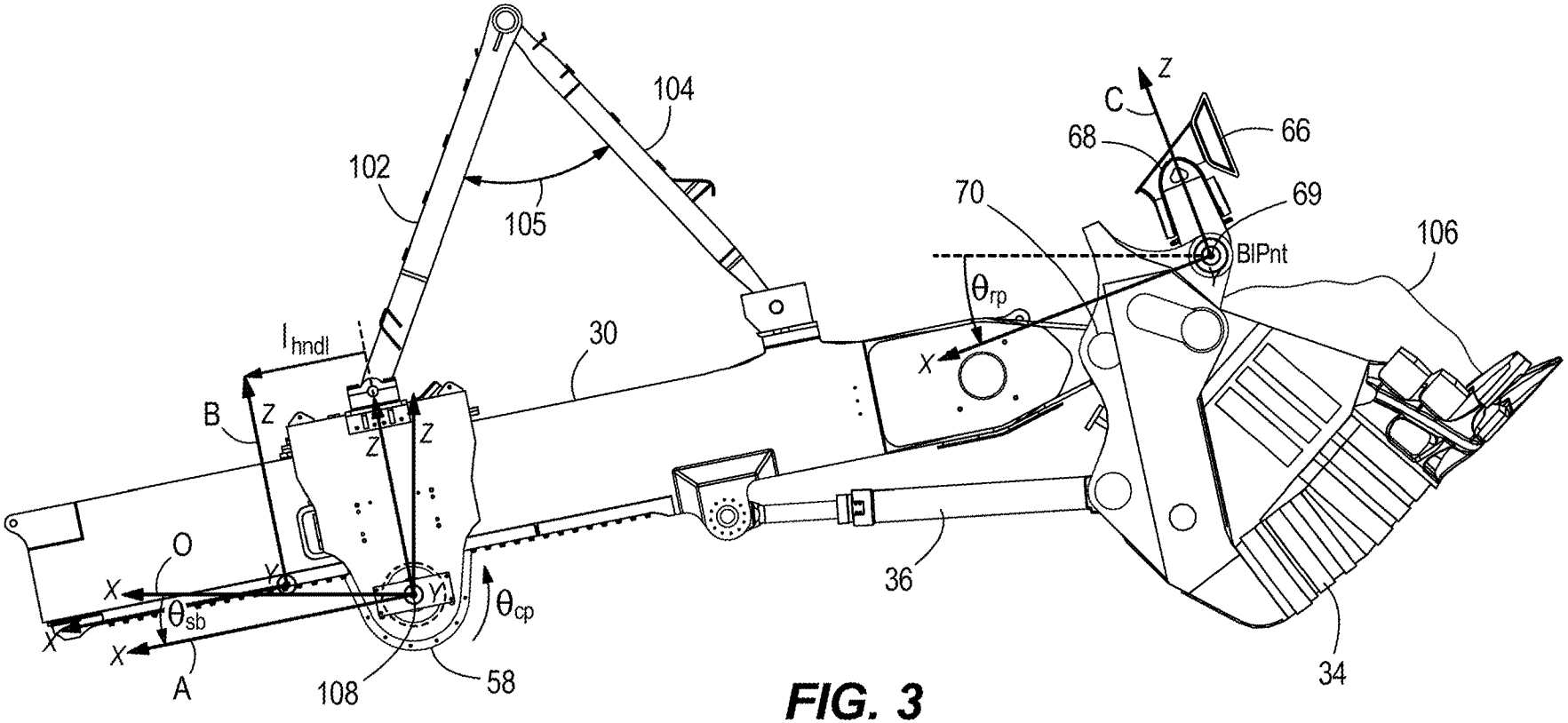
FIG. 3 is a side view of a handle and a bucket of the industrial machine of FIG. 1 according to some embodiments of the application.

FIG. 3 provides a side view of the handle 30 and the bucket 34 according to some embodiments. The handle 30 includes the pivot actuator 36, the saddle block 58, the aft link 102, and the forward link 104. Additionally, the bucket 34 includes a payload 106. The saddle block 58 includes a crowd pinion 108. The bail 66 includes a rope attach point 68 for the rope 42 and a bail point 69 at which the bail 66 pivotably coupled to the bucket 34. FIG. 3 also provides reference frame O, described in more detail below.

Figure 4:
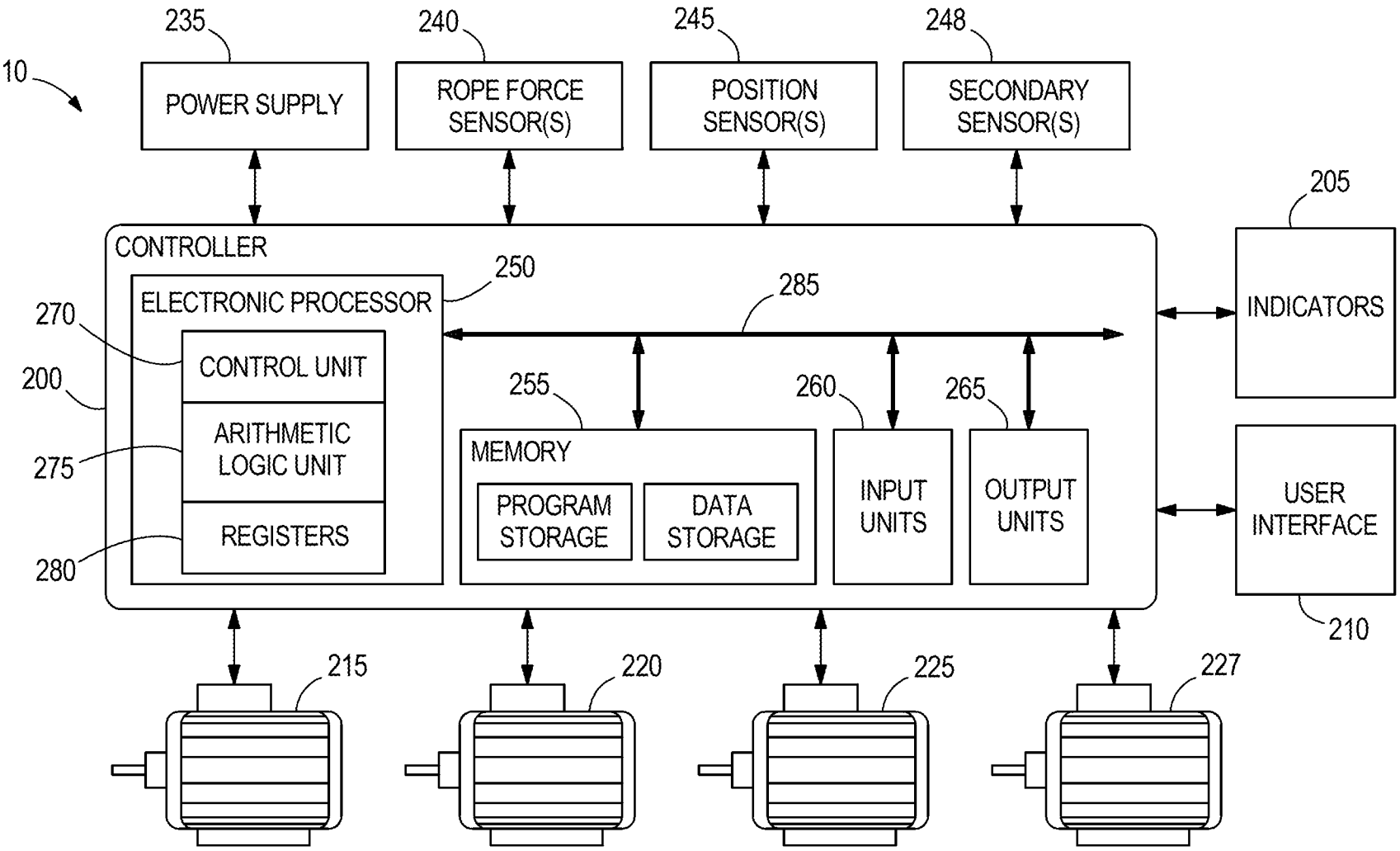
FIG. 4 is a block diagram of a control system of the industrial machine of FIG. 1 according to some embodiments of the application.

FIG. 4 illustrates a block diagram of the shovel 10. The shovel 10 includes a controller 200 that is electrically and/or communicatively connected to a variety of modules or components of the shovel 10. For example, the illustrated controller is connected to one or more indicators 205, a user interface module 210, a crowd drive 215, a hoist drive 220, a swing drive 225, a tracks drive 227, a power supply 235, one or more rope force sensor(s) 240, one or more position sensor(s) 245, and one or more secondary sensor(s) 248.

The controller 200 includes combinations of hardware and software that are configured, operable, and/or programmed to, among other things, control the operation of the shovel 10, generate sets of control signals to activate the one or more indicators 205 (e.g., a liquid crystal display ["LCD"], one or more light sources [e.g., LEDs], etc.), monitor the operation of the shovel 10, etc. The one or more secondary sensors 248 provide signals associated with operation of the shovel 10 and include, among other things, a loadpin, a strain gauge, one or more inclinometers, gantry pins, one or more motor field modules (e.g., measuring motor parameters such as current, voltage, power, etc.), one or more rope tension sensors, one or more resolvers, RADAR, LIDAR, one or more cameras, one or more infrared sensors, etc.

The one or more rope force sensor(s) 240 provide rope force signals to the controller 200 indicative of the force experienced by the rope 42 and/or the bail 66. The one or more rope force sensor(s) 240 may include, among other things, a load pin sensor and a hoist drive sensor. The load pin sensor may be situated in the joint between the boom point sheave 54 and the boom 26. In that configuration, the load pin sensor outputs a signal that varies based on the force on the sheave 54 supporting the rope 42 and, thus, indicates rope force for the rope 42. The hoist drive sensor outputs signals indicative of hoist torque of the hoist drive 220. For example, the hoist drive sensor may provide a hoist drive voltage and hoist drive current to the controller 200 such that the controller 200 can calculate hoist torque, or may output hoist torque to the controller 200. Because the hoist drive 220 drives the reeling in and letting out of the rope 42, the hoist torque is indicative of the rope force of the rope 42.

The one or more position sensor(s) 245 provide position signals to the controller 200 indicative of a current shovel position of the shovel 10. The one or more position sensor(s) 245 may include, among other things, (i) a hoist position sensor (e.g., a resolver) associated with the hoist drive 220 that provides position information for the hoist drive 220, (ii) a crowd position sensor (e.g., a resolver) associated with the crowd drive 215 that provides position information for the crowd drive 215, and (iii) a tilt actuator position sensor (e.g., a linear encoder) for the actuator 36 indicating an extension amount of the pivot actuator 36. The hoist resolver may provide a hoist resolver value to the controller 200 that indicates the rotational position of the hoist drive 220 and, thus, indicates the length of the rope 42 that has been let out (a hoist amount). The more of the rope 42 that has been let out, the lower the bucket 34. The crowd resolver may provide a crowd resolver value to the controller 200 that indicates the crowd extension amount of the handle 30. The greater the extension amount of the handle 30, the further bucket 34 is away from the base 22. The linear encoder may provide a linear encoder value to the controller 200 that indicates the extension amount of the actuator 36, which indicates the tilt angle of the bucket 34 with respect to the handle 30. By knowing the crowd resolver value, hoist resolver value, linear encoder value, and known kinematics of the shovel 10 (e.g., length of the handle 30, size of the bucket 34, size of the bail 66, diameter of the sheave 54, location of the saddle block 58 along the boom 26, and the like), and standard principles of Euclidian geometry, the controller 200 can calculate the current shovel position of the shovel 10, which may include one or more of the position of the bucket 34, handle 30, aft link 102, forward link 104, saddle block 58, pivot actuator 36, bail 66, bail point 69, other components of the shovel 10, and relative angles therebetween.

The controller 200 includes a plurality of electrical and electronic components that provide power, operational control, and protection to the components and modules within the controller 200 and/or shovel 10. For example, the controller 200 includes, among other things, an electronic processor 250 (e.g., a microprocessor, a microcontroller, or another suitable programmable device), a memory 255, input units 260, and output units 265. The electronic processor 250 includes, among other things, a control unit 270, an arithmetic logic unit ("ALU") 275, and a plurality of registers 280 (shown as a group of registers in FIG. 4), and is implemented using a known computer architecture (e.g., a modified Harvard architecture, a von Neumann architecture, etc.). The electronic processor 250, the memory 255, the input units 260, and the output units 265, as well as the various modules connected to the controller 200 are connected by one or more control and/or data buses (e.g., common bus 285). The control and/or data buses are shown generally in FIG. 4 for illustrative purposes. The use of one or more control and/or data buses for the interconnection between and communication among the various module and components would be known to a person skilled in the art in view of the embodiments described herein.

The memory 255 is a non-transitory computer readable medium that includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The electronic processor 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the shovel 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The power supply 235 supplies a nominal AC or DC voltage to the controller 200 or other components or modules of the shovel 10. The power supply 235 receives power from, for example, an engine-generator, and conditions that power (e.g., steps down, steps up, filters the power) and provides the conditioned power to the components of the shovel 10 and controller 200. For example, the power supply 235 may include a plurality of power supplies providing different power levels to different components of the shovel 10. For example, a first power supply of the power supply 235 may provide lower voltages to operate circuits and components within the controller 200 or shovel 10 and a second power supply provide power to the drives 215, 220, 225, 227. In other constructions, the controller 200 or other components and modules within the shovel 10 are powered by line voltage provided by a power cable coupled to a power station off-board the shovel 10, one or more batteries or battery packs, or another grid-independent power source (e.g., a solar panel, etc.).

The user interface module 210 is used to control or monitor the shovel 10. The user interface module 210 may be situated within the operator cab 120. The user interface module 210 includes a combination of digital and analog input or output devices used to achieve a desired level of control and monitoring for the shovel 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, or the like. The user interface module 210 can also be configured to display conditions or data associated with the shovel 10 in real-time or substantially real-time. For example, the user interface module 210 is configured to display measured electrical characteristics of the shovel 10, the status of the shovel 10, a payload estimation of the shovel 10, etc. In some implementations, the user interface module 210 is controlled in conjunction with the one or more indicators 205 (e.g., LEDs, speakers, etc.) to provide visual or auditory indications (e.g., from a horn of the shovel 10) of the status or conditions of the shovel 10. In some implementations, at least a portion of the user interface module 210 is off-board of the shovel 10 and includes control inputs enabling remote control of the shovel 10 by an operator not present in the operator cab 120. For example, at least a portion of the user interface module 210 may be on an external device, such as a mobile phone, a tablet, a personal computer, or the like.

The crowd drive 215, the hoist drive 220, the swing drive 225, and the tracks drive 227 may each include a respective motor and a drive controller configured to drive the motor based on commands from the controller 200. The commands may be generated in response to inputs received from an operator of the shovel 10 via the user interface 210. The commands may be in the form of a speed command, torque command, or another form. For example, in response to a speed command, the drive controller controls the motor to attain the requested speed either by increasing the torque to the motor until the requested speed is reached or decreasing the speed until the requested speed is reached by reducing the torque to the motor, controlling the motor to regeneratively brake, or driving the motor in reverse. As another example, in response to a torque command, which may include both a magnitude and direction component, the drive controller controls the motor with torque at the requested magnitude and direction.

Figure 5:
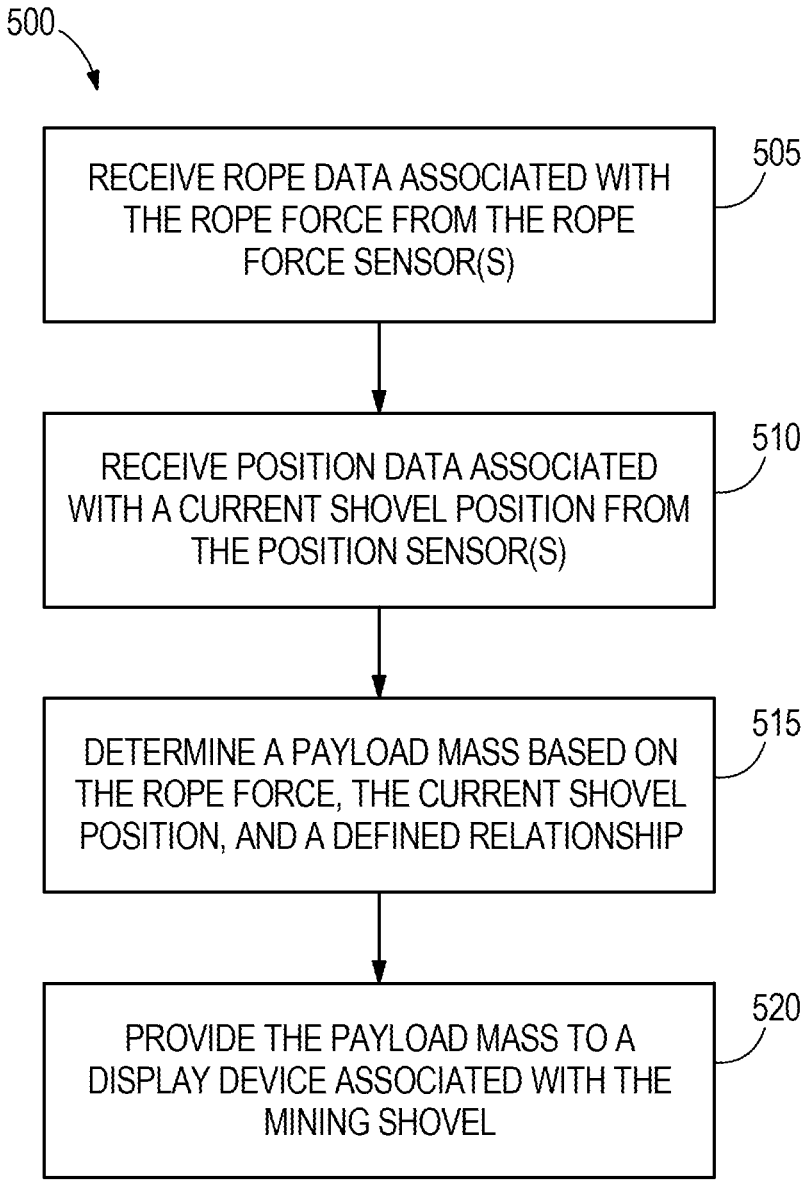
FIG. 5 is a flow chart illustration of an operation of the industrial machine of FIG. 1 according to some embodiments of the application.

FIG. 5 is a flowchart illustrating a method or operation 500 in accordance with some embodiments of the application. Specifically, method 500 provides a process of determining a mass of the payload 106. It should be understood that the order of the steps disclosed in operation 500 could vary. Additionally, steps may also be added to the control sequence, and not all of the steps may be required. The operation 500 may be performed by the controller 200 or another controller (e.g., a similarly constructed controller located off-board the shovel 10). The controller 200 receives rope data associated with the rope force from the one or more rope force sensor(s) 240 (block 505).

The controller 200 receives position data associated with a current shovel position from the position sensor(s) 245 (block 510). The controller 200 determines the mass of the payload 106 based on the rope force, the current shovel position, and a defined relationship between a kinetic energy of the mining shovel, a potential energy of the mining shovel, one or more degrees of freedom of the mining shovel, and one or more forces experienced by the mining shovel (block 515). For example, the rope force and the current shovel position (e.g., the position of the bucket 34, handle 30, aft link 102, forward link 104, saddle block 58, pivot actuator 36, bail 66, other components of the shovel 10) are used as inputs for a payload function stored in the memory 255. In some embodiments, the rope force and the current shovel position are used in conjunction with the masses of the bucket 34, handle 30, aft link 102, forward link 104, saddle block 58, pivot actuator 36, bail 66, other components of the shovel 10. In some embodiments, the defined relationship is a payload function derived from Lagrange's Equation of Motion (e.g., a Lagrangian-derived payload function), as described below in more detail. The control 200 provides the payload mass to a display device associated with the mining shovel (at block 520). For example, the payload mass is provided on the user interface module 210.

Lagrangian-Derived Payload Function

Generally, Lagrange's equation is an equation that defines a relationship between the kinetic energy, the potential energy, one or more degrees of freedom, and one or more generalized forces within an observed system. In the context of this application, the Lagrangian-derived payload function is a function, used to calculate the payload, that is derived from Lagrange's equation and defines a relationship between a kinetic energy, a potential energy, one or more degrees of freedom, and one or more forces experienced by the shovel 10. The change in the kinetic and potential energy over their degrees of freedom, and the change in kinetic energy over time, are added and equated with the general forces within the system. For example, using Lagrangian principles, an equation for the shovel 10 may be defined as:

$$\frac{d}{dt}\left(\frac{\partial T}{\partial \dot{q}_i}\right) - \frac{\partial T}{\partial q_i} + \frac{\partial V}{\partial q_i} = Q_i \quad \text{[Equation 1]}$$

Where:

T=Kinetic Energy

V=Potential Energy t=Time $q_i$=A Generalized Coordinate $Q_i$=A Generalized Force The payload mass of the payload function is determined at static equilibrium, or when the kinetic energy Tis equal to zero. Therefore, the equation becomes:

$$\frac{\partial V}{\partial q_i} = Q_i \quad \text{[Equation 2]}$$

Additionally, when determining the payload mass using the payload function, the only degree of freedom is that of the saddle block 58. Therefore, the equation further becomes:

$$\frac{\partial V}{\partial \theta_{sb}} = Q_{sb} \quad \text{[Equation 3]}$$

Where:

$\theta_{sb}$=Saddle Block Angle $Q_{sb}$=Generalized Force Experienced by Saddle Block Equation 3, when expanded to account for the system defined by the shovel 10, can be used to determine the payload mass, henceforth known as $m_{Pyld}$. Specifically, the payload function can be represented as a function of $m_{Pyld}$, $\theta_{sb}$, and the inertial location and masses of additional components of the shovel 10, such as the saddle block 58, handle 30, bucket 34, payload 106, aft link 102, forward link 104, pivot actuator 36, and bail 66.

To expand Equation 3 to calculate the payload function, the gravitational potential energy is used:

$$V=\Sigma m_i \cdot h_i \cdot g \quad \text{[Equation 4]}$$

Where:

$m_i$=Mass of Each Component $h_{Pyld}$=Height of Each Component g=Gravitational constant Using the gravitational potential energy in combination with Equation 3 at equilibrium, the payload function may be solved for payload mass as follows:

$$m_{Pyld} = \frac{Q_{sb} - \left(\Sigma\, m_{i-Pyld} \cdot \frac{\partial h_{i-Pyld}}{\partial \theta_{sb}} \cdot g\right)}{\frac{\partial h_{Pyld}}{\partial \theta_{sb}} \cdot g} \quad \text{[Equation 5]}$$

Figure 6:
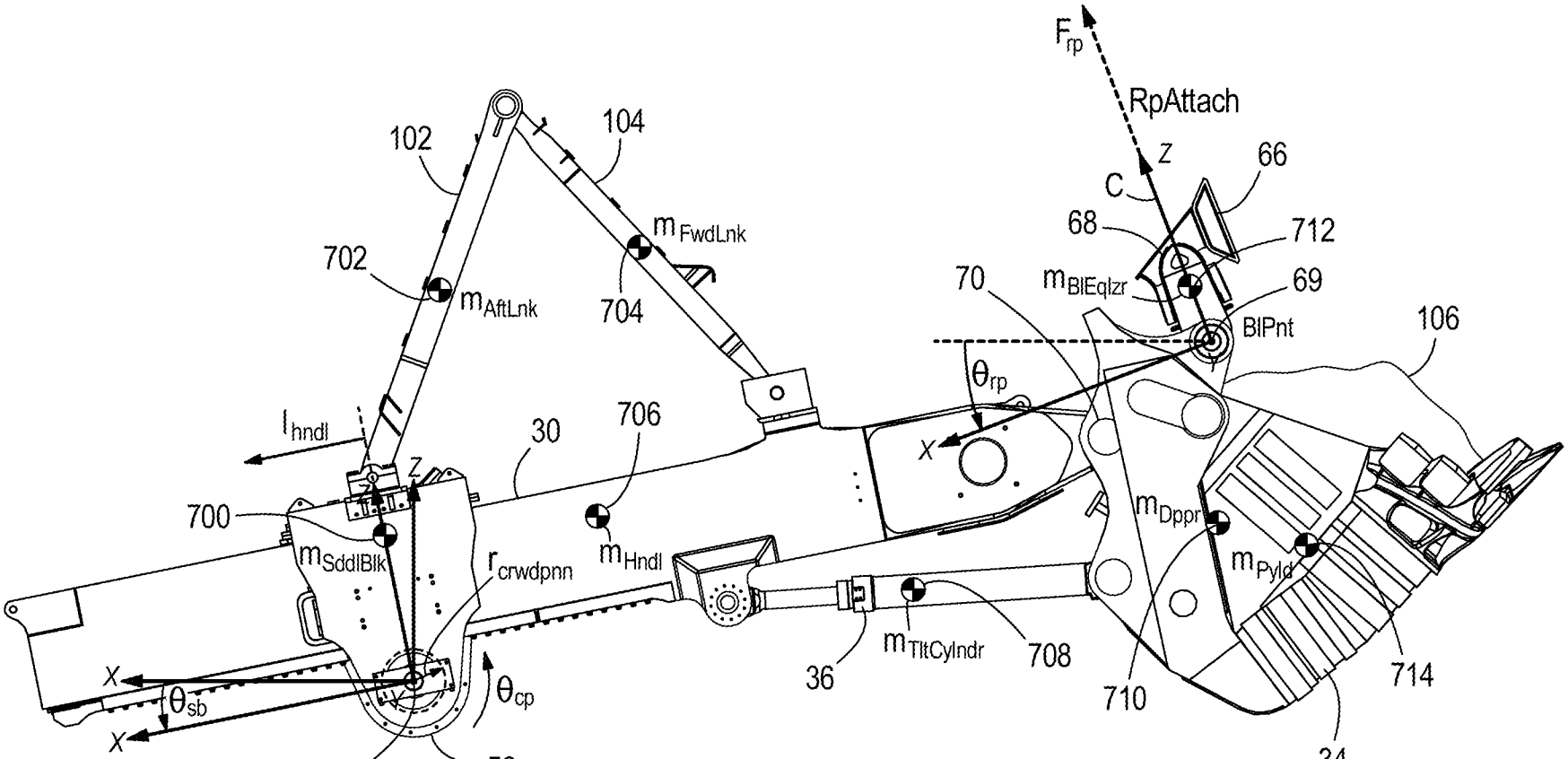
FIG. 6 is a side view of a handle, a bucket, and center of masses of the components of the handle and the bucket of the industrial machine of FIG. 1 according to some embodiments of the application.

Where:

$m_{Pyld}$=Payload Mass $h_{Pyld}$=Payload Height $m_{i\text{-}Pyld}$=Mass of Each Remaining Component $h_{i\text{-}Pyld}$=Height of Each Remaining Component $Q_{sb}$=Generalized Force Experienced by Saddle Block Accordingly, the payload mass is calculated based on detected and/or known masses and heights of other components of the mining shovel 10, such as, but not limited to, bucket 34, handle 30, aft link 102, forward link 104, saddle block 58, pivot actuator 36, and bail 66, in conjunction with the generalized force experienced by the saddle block 58 (e.g., determined based on the rope force ($F_{rp}$) illustrated in FIG. 6 and provided by the one or more rope force sensor(s) 240). The rope force is considered an external force to the system, and therefore is accounted for as part of (e.g., is a component within) $Q_{sb}$. More particularly, the controller 200 may generate a payload estimation by inserting known masses of components (retrieved from the memory 255), a value for the rope force ($F_{rp}$) (determined from the rope data (block 505)), and values for the current shovel position (determined from the position data (block 510)) into the payload function (e.g., Equation 5) and computing the result. In other words, the payload mass ($m_{pyld}$) 714 may be determined based on predetermined masses of shovel components along with real-time values for rope force and current shovel position.

With respect to the known masses, FIG. 6 is a side view of the handle 30 and the bucket 34 of the mining shovel 10 that also illustrates the center of mass of several components that may be included in the payload function. The centers of masses (also referred to as nominal masses) may include, for example, a saddle block mass ($m_{SadlBlk}$) 700, an aft link mass ($m_{AftLnk}$) 702, a forward link mass ($m_{FwdLnk}$) 704, a handle mass ($m_{Hndl}$) 706, a pinion actuator mass ($m_{TltCylndr}$) 708, a bucket mass ($m_{Dppr}$) 710, a bail mass ($m_{BlEqlzr}$) 712, and a payload mass ($m_{Pyld}$) 714. These nominal masses may be stored in the memory 255 as constants for use in the payload function.

With respect to the current shovel position values used in the payload function, the current shovel position provides values that may include one or more of an X-component, a Y-component, and a Z-component of the position for each component used to calculate the payload mass $m_{pyld}$. The X-, Y-, and Z-components of each position may be with reference to one or more coordinate frames, such as frame O shown in FIG. 3 and located at the center of the crowd pinion 108 parallel to the inertial frame. For example, the following current shovel position values may be used in the payload function: the saddle block angle ($\theta_{sb}$), the rope attach angle ($\theta_{rp}$), the z-coordinate of the bail point 69 in the O-reference frame ($p_{O2BlPntZ}$), the x-coordinate of the bail point 69 in the O-reference frame ($p_{O2BlPntX}$), the x-coordinate of the bucket 34 in the O-reference frame ($p_{O2Dpprx}$), the x-coordinate of the handle 30 in the O-reference frame ($p_{O2Hndlx}$), the x-coordinate of the payload 106 in the O-reference frame ($p_{O2Pyldx}$), the x-coordinate of the aft link 102 in the O-reference frame ($p_{O2AftLnkx}$), the x-coordinate of the forward link 104 in the O-reference frame ($p_{O2FwdLnkx}$), the x-coordinate of the saddle block 58 in the O-reference frame ($p_{O2SddlBlkx}$), and the x-coordinate of the pivot actuator 36 in the O-reference frame ($p_{O2TltCylindrx}$).

Additionally, as previously stated, the method 500 and the method 600 may be altered for industrial machines beyond the shovel 10, such as an electric rope shovel, a dragline excavator, or the like. Components may vary, and more or less components than the handle 30, the bucket 34, the aft link 102, the forward link 104, the saddle block 58, the pivot actuator 36, and the bail 66 may be used to solve the Lagrangian-derived payload function. For example, in some electric rope shovels, an aft link and forward link are not provided, and, accordingly, terms for the aft link and forward link may be left off of the above-described equations when solving the Lagrangian equation and generating a payload estimation.

Thus, the application provides, among other things, a system and method for accurately determining a payload mass of an industrial machine. Various features and advantages of the application are set forth in the following claims.

What is claimed is:

1. A mining shovel comprising:

a base;

a handle rotationally coupled to the base;

a bucket coupled to the handle;

a rope force sensor configured to indicate a rope force on a rope supporting the bucket and the handle;

one or more position sensors configured to indicate a current shovel position; and a controller including an electronic processor and a memory, the controller coupled to the rope force sensor and to the one or more position sensors, the controller configured to:

receive rope data indicative of the rope force from the rope force sensor, receive position data indicative of the current shovel position from the one or more position sensors, determine a payload mass based on the rope force, the current shovel position, and a defined relationship between a kinetic energy of the mining shovel, a potential energy of the mining shovel, one or more degrees of freedom of the mining shovel, and one or more forces experienced by the mining shovel, and provide the payload mass to a display device associated with the mining shovel.

2. The mining shovel of claim 1, further comprising:

a crowd drive configured to extend and retract the handle relative to the base;

a hoist drive configured to reel in and let out the rope; and a tilt actuator configured to adjust a tilt angle of the bucket with respect to the handle, wherein the one or more position sensors include a hoist position sensor configured to indicate an amount of the rope that is let out, a crowd position sensor configured to indicate an extension amount that the handle is extended, and a tilt actuator position sensor configured to indicate a tilt amount of the bucket.

3. The mining shovel of claim 1, wherein the mining shovel includes one or more selected from a group consisting of a saddle block, an aft link, a forward link, a tilt cylinder, and a bail.

4. The mining shovel of claim 3, wherein a mass of each of the one or more selected from the group consisting of the saddle block, the aft link, the forward link, the tilt cylinder, and the bail are accounted for in the defined relationship.

5. The mining shovel of claim 1, wherein the defined relationship assumes that the kinetic energy of the mining shovel is zero.

6. The mining shovel of claim 1, wherein determining the payload mass includes deriving the defined relationship between a kinetic energy of the mining shovel, a potential energy of the mining shovel, one or more degrees of freedom of the mining shovel, and one or more forces experienced by the mining shovel, and wherein deriving the defined relationship includes setting an origin of a vector system at a crowd pinion of the mining shovel.

7. The mining shovel of claim 6, wherein deriving the defined relationship includes deriving equilibrium for a saddle block angle by equating the potential energy of the mining shovel with the one or more forces experienced by the mining shovel at the saddle block angle.

8. The mining shovel of claim 1, wherein the rope force sensor is a load pin, and wherein the load pin is located between a boom point sheave and a boom.

9. The mining shovel of claim 1, wherein the rope force sensor is a hoist drive sensor that provides the rope data indicative of a hoist drive voltage, and wherein the hoist drive voltage is used to determine the rope force.

10. The mining shovel of claim 1, wherein the current shovel information includes an X-component, a Y-component, and a Z-component for at least one selected from a group consisting of the bucket, the handle, an aft link, a forward link, a pivot actuator, a saddle block, a rope attach point, a bail point, and a payload.

11. A method of determining a payload mass for a mining shovel, the method comprising:

receiving, at an electronic processor, rope data from a rope force sensor indicative of a rope force on a rope supporting a bucket and a handle of the mining shovel, receiving, at the electronic processor, position data from one or more position sensors indicative of a current shovel position of the mining shovel, determining a payload mass based on the rope force, the current shovel position, and a defined relationship between a kinetic energy of the mining shovel, a potential energy of the mining shovel, one or more degrees of freedom of the mining shovel, and one or more forces experienced by the mining shovel, and providing the payload mass to a display device associated with the mining shovel.

12. The method of claim 11, wherein the one or more position sensors include a hoist position sensor configured to indicate an amount of a rope that is let out by a hoist drive, a crowd position sensor configured to indicate an extension amount that the handle is extended by a crowd drive, and a tilt actuator position sensor configured to indicate a tilt amount of the bucket by a tilt actuator.

13. The method of claim 11, wherein the mining shovel includes one or more selected from a group consisting of a saddle block, an aft link, a forward link, a tilt cylinder, and a bail.

14. The method of claim 13, wherein a mass of each of the one or more selected from the group consisting of the saddle block, the aft link, the forward link, the tilt cylinder, and the bail are accounted for in the defined relationship.

15. The method of claim 11, wherein determining the payload mass includes assuming the kinetic energy of the mining shovel is zero.

16. The method of claim 11, wherein determining the payload mass includes deriving the defined relationship between a kinetic energy of the mining shovel, a potential energy of the mining shovel, one or more degrees of freedom of the mining shovel, and one or more forces experienced by the mining shovel, and wherein deriving the defined relationship includes setting an origin of a vector system at a crowd pinion of the mining shovel.

17. The method of claim 16, wherein deriving the defined relationship includes deriving equilibrium for a saddle block angle by equating the potential energy of the mining shovel with the one or more forces experienced by the mining shovel at the saddle block angle.

18. The method of claim 11, wherein the rope force sensor is a load pin, and wherein the load pin is located between a boom point sheave and a boom.

19. The method of claim 11, wherein the rope force sensor is a hoist drive sensor that provides the rope data indicative of a hoist drive voltage, and wherein the hoist drive voltage is used to determine the rope force.

20. The method of claim 11, wherein the current shovel information includes an X-component, a Y-component, and a Z-component for at least one selected from a group consisting of the bucket, the handle, an aft link, a forward link, a pivot actuator, a saddle block, a rope attach point, a bail point, and a payload.

21. A control system for a mining machine having a base, a handle rotationally coupled to the base, a bucket coupled to the handle, a rope force sensor configured to indicate a rope force on a rope supporting the bucket and the handle, one or more position sensors configured to indicate a current shovel position, the control system comprising:

an electronic controller including an electronic processor and a memory, the electronic controller coupled to the rope force sensor and to the one or more position sensors, the controller configured to:

receive rope data indicative of the rope force from the rope force sensor, receive position data indicative of the current shovel position from the one or more position sensors, determine a payload mass based on the rope force, the current shovel position, and a defined relationship between a kinetic energy of the mining shovel, a potential energy of the mining shovel, one or more degrees of freedom of the mining shovel, and one or more forces experienced by the mining shovel, and provide the payload mass to a display device associated with the mining shovel.

22. The control system of claim 21, wherein the mining machine further includes a crowd drive configured to extend and retract the handle relative to the base, a hoist drive configured to reel in and let out the rope, and a tilt actuator configured to adjust a tilt angle of the bucket with respect to the handle, wherein the one or more position sensors include a hoist position sensor configured to indicate an amount of the rope that is let out, a crowd position sensor configured to indicate an extension amount that the handle is extended, and a tilt actuator position sensor configured to indicate a tilt amount of the bucket.

23. The control system of claim 21, wherein the mining shovel includes one or more selected from a group consisting of a saddle block, an aft link, a forward link, a tilt cylinder, and a bail.

24. The control system of claim 23, wherein a mass of each of the one or more selected from the group consisting of the saddle block, the aft link, the forward link, the tilt cylinder, and the bail are accounted for in the defined relationship.

25. The control system of claim 21, wherein the defined relationship assumes that the kinetic energy of the mining shovel is zero.

26. The control system of claim 21, wherein determining the payload mass includes deriving the defined relationship between a kinetic energy of the mining shovel, a potential energy of the mining shovel, one or more degrees of freedom of the mining shovel, and one or more forces experienced by the mining shovel, and wherein deriving the defined relationship includes setting an origin of a vector system at a crowd pinion of the mining shovel.

27. The control system of claim 26, wherein deriving the defined relationship includes deriving equilibrium for a saddle block angle by equating the potential energy of the mining shovel with the one or more forces experienced by the mining shovel at the saddle block angle.

28. The control system of claim 21, wherein the rope force sensor is a load pin, and wherein the load pin is located between a boom point sheave and a boom.

29. The control system of claim 21, wherein the rope force sensor is a hoist drive sensor that provides the rope data indicative of a hoist drive voltage, and wherein the hoist drive voltage is used to determine the rope force.

30. The control system of claim 21, wherein the current shovel information includes an X-component, a Y-component, and a Z-component for at least one selected from a group consisting of the bucket, the handle, an aft link, a forward link, a pivot actuator, a saddle block, a rope attach point, a bail point, and a payload.

* * * * *